US006981555B2

(12) United States Patent
Smith et al.

(10) Patent No.: US 6,981,555 B2
(45) Date of Patent: Jan. 3, 2006

(54) MODULAR FIRE DETECTION AND EXTINGUISHING SYSTEM

(76) Inventors: Bradley W. Smith, 1035 N. 3650 West, Ogden, UT (US) 84404; David W. Lindsey, 2626 W. 3850 North, Farr West, UT (US) 84404; Marcus T. Clark, 39 N. 400 East, Kaysville, UT (US) 84037

( * ) Notice: Subject to any disclaimer, the term of this patent is extended or adjusted under 35 U.S.C. 154(b) by 0 days.

(21) Appl. No.: 10/074,602

(22) Filed: Feb. 11, 2002

(65) Prior Publication Data

US 2003/0150625 A1 Aug. 14, 2003

(51) Int. Cl.

| | |
|---|---|
| ***A62C 3/07*** | (2006.01) |
| ***A62C 3/08*** | (2006.01) |
| ***A62C 35/00*** | (2006.01) |
| ***A62C 37/00*** | (2006.01) |
| ***A62C 37/10*** | (2006.01) |

(52) U.S. Cl. ..... 169/62; 169/56; 169/59; 169/60; 169/61

(58) Field of Classification Search ..... 169/62, 169/56, 59, 60, 61, 65, 73, 71, 72, 30, 84, 169/5, 6, 9, 77, 85, 26; 102/530, 531; 280/741; 340/425.5, 588, 589, 691.6, 692

See application file for complete search history.

(56) References Cited

U.S. PATENT DOCUMENTS

| | | | | |
|---|---|---|---|---|
| 3,972,373 | A * | 8/1976 | Nichols et al. | 169/62 |
| 3,993,138 | A | 11/1976 | Stevens et al. | |
| 5,207,276 | A * | 5/1993 | Scofield | 169/61 |
| 5,590,718 | A | 1/1997 | Bertossi | |
| 5,613,564 | A | 3/1997 | Rhines | |
| 5,651,416 | A | 7/1997 | Clauson et al. | |
| 5,660,236 | A * | 8/1997 | Sears et al. | 169/72 |
| 5,941,315 | A * | 8/1999 | Lai et al. | 169/62 |
| 5,960,888 | A | 10/1999 | Moore, Sr. | |
| 5,992,528 | A * | 11/1999 | Parkinson et al. | 169/6 |
| 6,164,383 | A | 12/2000 | Thomas | |
| 6,317,665 | B1 | 11/2001 | Tabata et al. | |
| 6,371,213 | B1 * | 4/2002 | Smith et al. | 169/73 |
| 6,378,617 | B1 * | 4/2002 | Brennan | 169/62 |
| 6,513,602 | B1 * | 2/2003 | Lewis et al. | 169/84 |

* cited by examiner

*Primary Examiner*—David A. Scherbel
*Assistant Examiner*—Darren Gorman
(74) *Attorney, Agent, or Firm*—Sally J Brown

(57) ABSTRACT

A modular fire detection and extinguishing system is disclosed that is inexpensive, compact, and modular to allow easy aftermarket installation in a variety of vehicles. The system may include a detector, a trigger coupled to the detector and a gas generant fire extinguisher, a modular distribution line in fluid communication with the extinguisher and a nozzle. The system allows exhaust gas from the gas generant fire extinguisher to carry dry powdered fire suppressant from the fire extinguisher and through the nozzle to disperse the fire suppressant substantially uniformly throughout a fire hazard zone. The extinguisher is installed such that exhaust gas must aerate substantially all the fire suppressant before exiting the extinguisher.

24 Claims, 4 Drawing Sheets

MODULAR FIRE DETECTION AND EXTINGUISHING SYSTEM

BACKGROUND OF THE INVENTION

1. The Field of the Invention

The present invention relates to automatic fire detection and extinguishing systems. More specifically, the invention relates to a stand alone compact modular fire detection and extinguishing system.

2. Technical Background

Vehicle fires may occur in motor vehicles during normal operation or when a vehicle is involved in an accident. Generally, these fires begin in the engine compartment. While these kinds of fires may occur infrequently, when they occur, they can transform a minor fuel leak or fender bender into a costly and dramatic vehicle fire requiring significant repairs, resulting in total loss of the vehicle, or most importantly, injuring or killing vehicle occupants and/or by standers.

Often, occupants can escape the fire danger. However, the property damage can be significant. In one estimate, in one year, 332,900 light weight vehicle (GVWR<4500 kg) fires were reported in the U.S., resulting in approximately $737 million in property damage.

Combating such fires with a manual fire extinguisher is generally impracticable. Often, attempts to extinguish the fire with a manual fire extinguisher are ineffective or endanger the extinguisher operator. Automatic fire extinguisher systems (AFES) have been developed to detect and extinguish engine compartment fires to reduce the danger.

Unfortunately, Automatic fire extinguisher systems (AFES) have deficiencies and problems which limit their wide spread use, particularly with owners of light weight vehicles. Most importantly, AFES are generally very expensive and complicated when compared with the relatively low risk of a vehicle fire. Generally, an AFES includes multiple components which must be purchased separately and assembled by the vehicle owner. Purchasing the components separately increases the overall cost of the system.

Generally, installing an AFES involves disciplines such as physics, electronics, and auto mechanics. These disciplines generally discourage a vehicle owner from installing the AFES. Therefore, an expert generally installs the system, particularly with an aftermarket AFES. Expert installation increases the AFES expense.

Furthermore, conventional AFESs are ineffective at extinguishing the fire in certain fire hazard zones. In addition, some AFESs further endanger vehicle occupants when taking steps to extinguish a fire such as shutting down the engine. Fire involves a chemical reaction between a fuel and oxygen which occurs at a critical temperature. Thus, the AFES removes one or more of these elements to extinguish a fire.

Some AFESs disperse an AFFF (aqueous film-forming foam) fire suppressant to separate the fuel from the oxygen and cool the burning area. However, these systems are generally minimally effective. Generally, a fire occurs on or around the engine block, and/or exhaust manifold (the hotter parts of the engine). However, these components are generally covered by a number of other components including fuel injectors, air intake ducts, fan belts, plastic housings, wires and cables, and the like. AFFF systems are less effective because the foam is only applied to the exposed surfaces. The attached components prevent the foam from reaching the sources of the fire.

Other AFESs reach a fire's source but suffer from other disadvantages. In some systems, a compartment in which a fire starts is flooded with an inert gas. The inert gas removes the oxygen from the fire. The inert gas readily surrounds the attached components to reach the fire source. However, to quench the fire the oxygen must be removed long enough to allow the burning area to cool. The time period could be several seconds.

These systems work well in enclosed compartments. However, typical vehicle engine compartments include one or two sides which are mostly open. For example, the area below the engine is generally open and, in an accident, the hood may be opened or completely removed. These openings allow the inert gas to escape and oxygen to return to the burning area and re-start the fire.

Other AFESs require expensive routine maintenance to ensure the system is not leaking, that a powdered suppressant has not become settled or 'caked', or otherwise inoperable. Other systems include such bulky components that installation is difficult or impossible due to the limited space in the engine compartments of most light weight vehicles.

Some AFESs reduce the heat in the engine compartment by automatically shutting down the engine. This can also reduce the amount of fuel, gasoline and oil, being provided to the fire. However, shutting down the engine may endanger vehicle occupants. The vehicle may become disabled in the fast lane of a busy highway or during adverse weather conditions. In addition, normally powered systems such as steering and/or braking become more difficult when the engine is shut off.

Other AFESs are inoperable if the main power source, a vehicle's alternator and/or battery, is disabled by the fire. Some AFESs include a secondary power source, but the secondary power source is physically separated from the system trigger requiring the power. Thus, the connection between the primary and secondary power sources may be compromised before the system is triggered.

Conventional AFESs are generic and inflexible because they are designed to be installed aftermarket and accommodate as large a number of vehicle types as possible. The systems may be available in only a few configurations. Aftermarket refers to parts installed on a vehicle other than the parts installed during original vehicle manufacture. However, because the systems are generic, the systems are typically only effective in a few vehicle types. Thus, vehicles which use these aftermarket systems may be provided with only a false sense of security.

Accordingly, it would be an advancement in the art to provide an automatic fire extinguisher system (AFES) which is inexpensive when compared to the probability of a vehicle fire. It would be a further advancement to provide an AFES which requires no maintenance. Additionally, it would be an advancement in the art to provide an AFES which effectively suppresses a fire in a non-enclosed engine compartment. Furthermore, it would be an advancement in the art to provide an AFES which is compact and modular to allow easy installation in a variety of vehicles during original manufacture or as aftermarket systems. A further advancement in the art would be to provide an AFES which warns a driver of a fire, safely shuts down the engine, and provides multiple power sources to ensure AFES operation. The present invention provides these advancements in a novel and useful way.

BRIEF SUMMARY OF THE INVENTION

The apparatus of the present invention has been developed in response to the present state of the art, and in particular, in response to the problems and needs in the art that have not yet been fully solved by currently available automatic fire extinguisher systems (AFES). Thus, the present invention provides a modular AFES that is self-contained, compact, and effective in suppressing fire within a fire hazard area.

In one embodiment, the system includes a detector. The detector may comprise a linear temperature sensitive cable in which two conductive wires connect to complete a circuit when the temperature along the cable is high enough to melt the insulation between the wires. Alternatively, spot detectors, which measure the ambient temperature in a particular location, may complete a circuit when the temperature reaches a pre-determined level. One or more detectors may be used together within a fire hazard area such as a kitchen or within an engine compartment.

The detector is electronically coupled to a trigger which activates a gas generant fire extinguisher. The trigger includes an electrical circuit having a switch and at least one power source. When the detector detects a fire, an electrical signal activates the switch. The switch allows an initiation signal to be sent to an initiator to activate a gas generant fire extinguisher.

The trigger may include a first power source and a second power source. The first power source may be a battery and the second power source may be a capacitor. In certain embodiments, the first power source may serve as a back-up power source to a main power source which is the vehicle's battery and/or alternator. Alternatively, the first power source may be the main power source allowing the AFES to operate independently of other systems. Preferably, the first power source and second power source are connected in parallel to allow one to function if the other does not. In a preferred embodiment, the second power source is physically located proximal to the switch to ensure that the switch is provided with sufficient power to activate the gas generant fire extinguisher.

The gas generant fire extinguisher includes a housing which stores gas generant, fire suppressant, and an initiator electrically coupled to the trigger. The initiator activates the gas generant. An orifice plate having an exhaust gas orifice is positioned within the housing between the gas generant and fire suppressant.

Preferably, the gas generant fire extinguisher is installed such that gravity acts to hold the fire suppressant in substantially constant contact with the exhaust gas orifice. The exhaust gas orifice is positioned such that exhaust gas generated by activating the gas generant passes through the fire suppressant to exit the housing. Preferably, the fire suppressant is a dry powdered suppressant. The exhaust gas passing through the exhaust gas orifice suspends and carries the fire suppressant.

The exhaust gas exits the housing via an exit port. Preferably, the exit port is connected to a modular distribution line having a nozzle. Preferably, one or more different length distribution lines may be coupled together with fasteners to allow the present invention to be adapted to various fire hazard zones. In one embodiment, the distribution lines are readily configurable for engine compartments of various vehicle types.

The exhaust gas carries the fire suppressant through the distribution lines and out the nozzle. The nozzle disperses the fire suppressant substantially uniformly throughout a fire hazard zone such as an engine compartment. In one embodiment, a manifold connected to the exit port allows a plurality of modular distribution lines to distribute the exhaust gas in multiple directions.

In an alternative embodiment, a controller is coupled between the detector and the trigger. The controller may comprise an arithmetic logic unit, state machine, central processing unit (CPU), a main vehicle control system, or the like. The controller generates a trigger signal when one or more pre-conditions are satisfied. For example, the controller may only send a trigger signal to the trigger when a vehicle slows below a certain speed, or a pre-determined time interval has elapsed from the time a fire was detected. Alternatively, the pre-condition may be whether a vehicle engine has been shut down.

The controller may be coupled to a notification module to notify a driver that an engine fire has been detected. The notification module may send a message asking the driver to stop the vehicle. In one embodiment, based on satisfaction of one or more pre-conditions, the controller may send a stop signal to a shut-down module to shut down the engine.

BRIEF DESCRIPTION OF THE DRAWINGS

In order that the manner in which the above-recited and other advantages of the invention are obtained and may be readily understood, a more particular description of the invention briefly described above will be rendered by reference to specific embodiments thereof which are illustrated in the appended drawings. Understanding that these drawings depict only typical embodiments of the invention, and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention can be better understood with reference to the drawings where like parts are designated with like numerals throughout.

Figure 1:
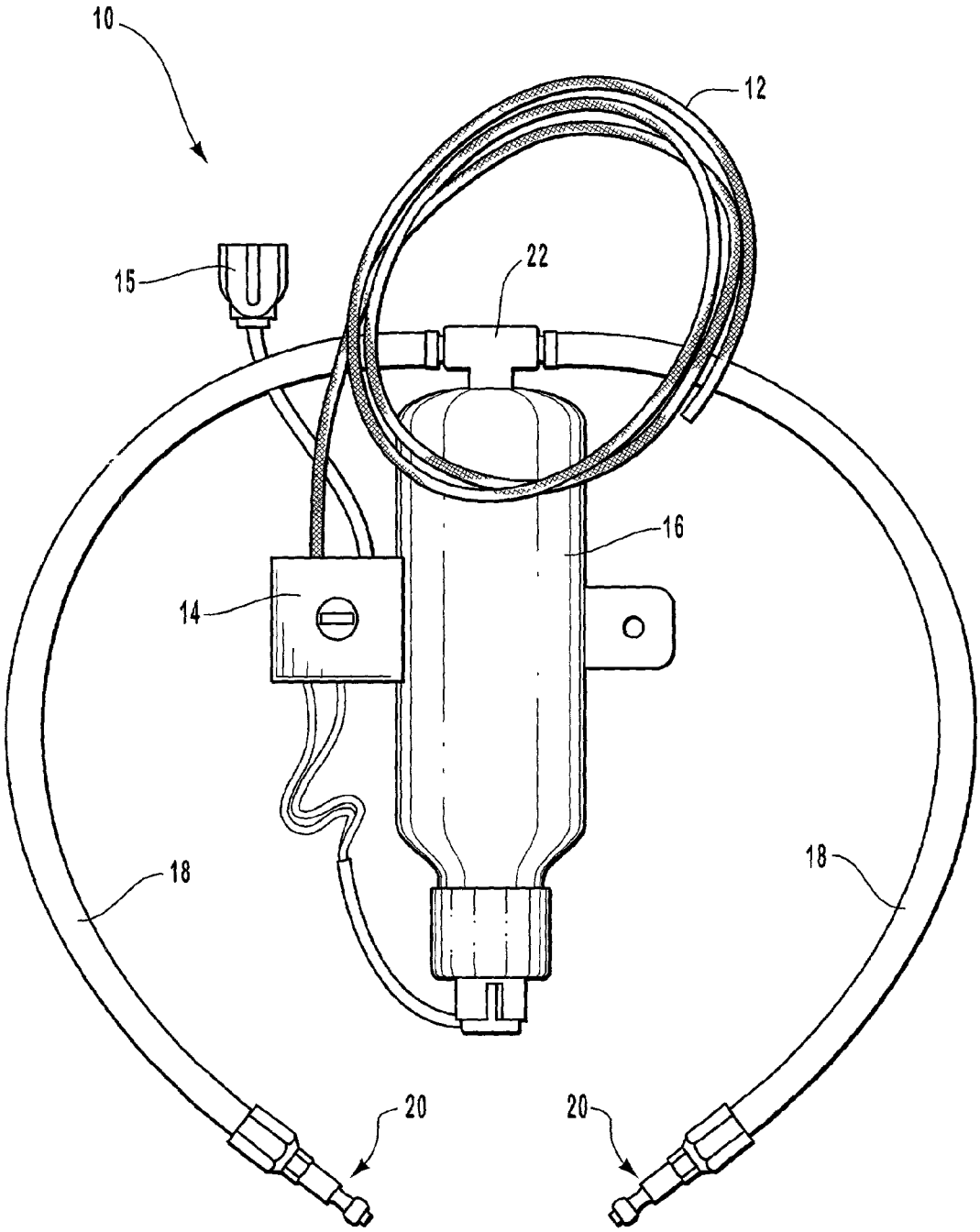
FIG. 1 is a perspective view illustrating one embodiment of a modular fire detection and extinguishing system.

FIG. 1 is a perspective view illustrating one embodiment of an automatic fire extinguisher system (AFES) 10. The AFES 10 includes a detector 12, a trigger 14, a gas generant fire extinguisher 16, and one or more modular distribution lines 18. Preferably, an AFES 10 is installed in an area which is predisposed to fires in that area, defined as a fire hazard zone. In a preferred embodiment, the fire hazard zone may be an engine compartment of a vehicle. Alternatively, the fire hazard zone may include cooking systems of a kitchen, machinery in a factory, or the like.

In certain embodiments, the detector 12 is a linear temperature sensitive cable. The cable includes two conductive wires which are covered by insulation. The insulation is designed to melt at a certain temperature. Generally, the melting temperature is such that the detector 12 may be used in very high temperature environments and yet the insulation only melts when a fire occurs. The wires are twisted around each other such that when a fire melts the insulation, the wires will connect to complete an electrical circuit.

Alternatively, other spot detectors (not shown) may be used which detect a change in temperature in a localized area. Generally, these spot detectors also close an electrical circuit when a fire is detected. Thus, the detector 12 acts as an electric switch which closes when a fire is detected.

A particular AFES may include a single detector 12 or a plurality of detectors 12 connected in parallel such that activation of any detector 12 will close an electrical connection. A linear temperature sensitive detector 12 may be preferred because the detector 12 is able to detect a fire at any point along the length of the cable. Thus, the detector 12 may be easily installed in a fire hazard area. For example, the detector 12 may be strung around the perimeter of a fire hazard zone. In an engine compartment, the detector 12 may surround the engine, transmission, and other components which are prone to catch fire.

The detector 12 is electrically coupled to an electrical circuit of a trigger 14. In one embodiment, when the detector 12 detects a fire, an electrical connection within the circuit of the trigger 14 is closed. Closing the circuit generates an initiation signal which is sent from the trigger 14 to a gas generant fire extinguisher 16.

In certain embodiments, the trigger 14 includes an independent power source (not shown), such as a battery. Alternatively, or in addition, a plug 15 may electrically couple the trigger 14 to a main power source. The main power source may be electricity from a standard electrical wall outlet or a vehicle's alternator and/or battery.

In one embodiment, the initiation signal activates gas generant stored within the gas generant fire extinguisher 16 to generate exhaust gas. The exhaust gas passes through fire suppressant stored within the extinguisher 16. The fire suppressant is suspended by the exhaust gas and carried out of the gas generant fire extinguisher 16.

A modular distribution line 18 connected to the gas generant fire extinguisher 16 carries the exhaust gas to a nozzle 20. The nozzle 20 disperses the exhaust gas and fire suppressant substantially uniformly throughout the fire hazard zone. In the illustrated embodiment, the gas generant fire extinguisher 16 may include a manifold 22 which allows exhaust gas and fire suppressant to be evenly distributed between two or more distribution lines 18.

Figure 2:
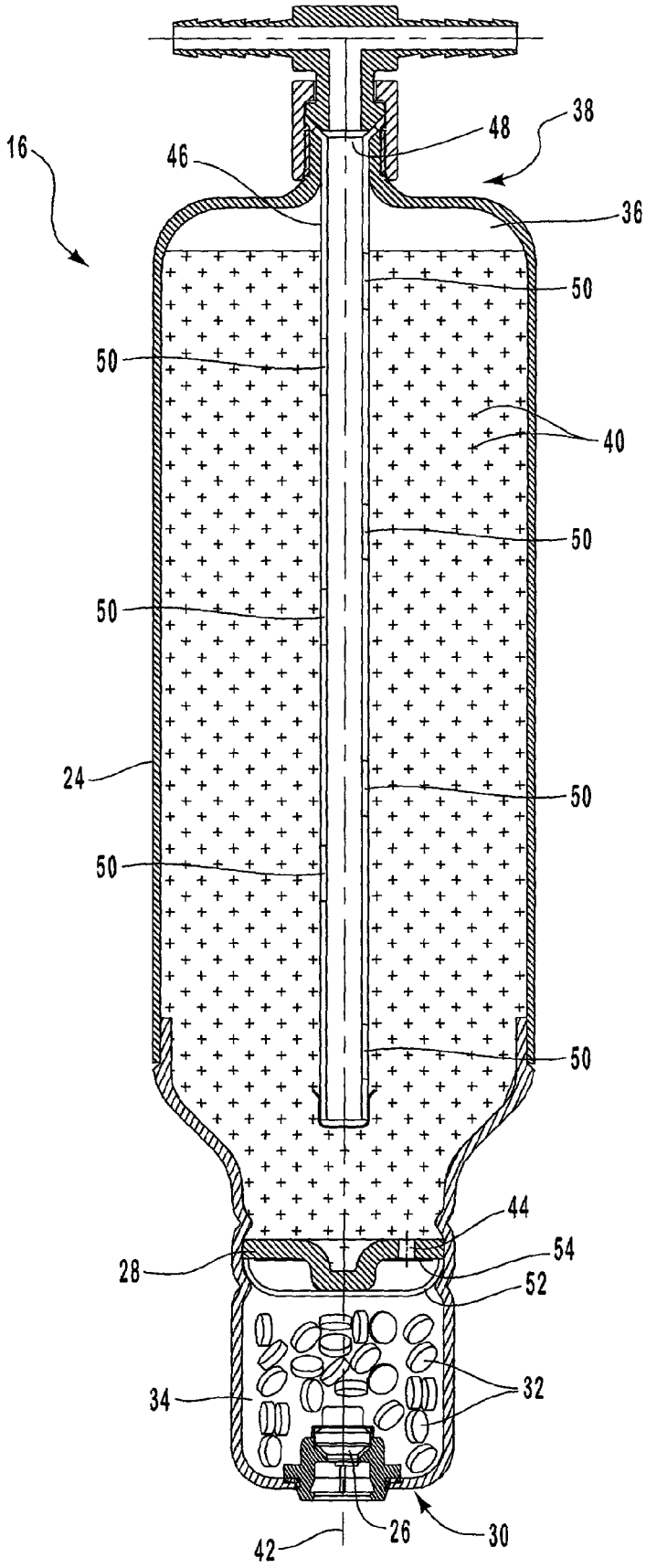
FIG. 2 is a cross-section view illustrating one embodiment of a gas generant fire extinguisher.

FIG. 2 illustrates a cross-sectional view of a gas generant fire extinguisher 16. Preferably, the extinguisher 16 includes a housing 24, an initiator 26, and an orifice plate 28. The initiator 26 is preferably connected to a bottom end 30 of the housing 24. The initiator 26 operably communicates with the gas generant 32 stored within a combustion chamber 34. The orifice plate 28 separates the combustion chamber 34 from a storage chamber 36. In a preferred embodiment, the storage chamber 36 extends from the orifice plate 28 to the top end 38 of the housing 24. The storage chamber 36 stores a fire suppressant 40.

Preferably, the housing 24 is cylindrical. Alternatively, the housing 24 may be of various geometric shapes. The housing 24 provides a rigid structure for storing the fire suppressant 40 and gas generant 32. The housing 24 also contains high pressure exhaust gas generated within the combustion chamber 34. The housing 24 may be fabricated from a single piece or a plurality of pieces of metal, ceramic, or other material providing similar strength and durability which are joined together.

The initiator 26 activates the gas generant 32. In a preferred embodiment, the initiator 26 is positioned coaxially with a longitudinal axis 42 of the housing 24. In one embodiment, the initiator 26 activates the gas generant 32 when an initiation signal, electrical current, is sent to the initiator 26. In a preferred embodiment, the initiator 26 provides about two ohms of resistance to the current. The resistance generates heat which activates the gas generant 32 to produce high velocity, rapidly expanding exhaust gas.

The exhaust gas quickly fills and pressurizes the combustion chamber 34. As the pressure increases, the high pressure exhaust gas begins to escape through at least one exhaust gas orifice 44 formed in the orifice plate 28. The orifice plate 28 regulates the flow of exhaust gas through the fire suppressant 40 in the storage chamber 36.

As the exhaust gas passes through the fire suppressant 40, the fire suppressant 40 is suspended within the exhaust gas. As more exhaust gas enters the storage chamber 36, the cylindrical shape of the storage chamber 36 causes the exhaust gas to circulate in a spiral direction toward the longitudinal axis 42. In certain embodiments, the exhaust gas enters a pickup tube 46 positioned coaxially with the longitudinal axis 42. The pickup tube 46 is in fluid communication with an exit port 48 which allows the exhaust gas to exit the extinguisher 16.

The pickup tube 46 channels the exhaust gas and suspended fire suppressant 40 from the storage chamber 36 to the top end 38. The pickup tube 46 may extend from the top end 38 of the housing 24 for substantially the whole length of the storage chamber 36. The pickup tube 46 may include slots 50 which allow the exhaust gas to carry the fire suppressant 40 into the tube 46 and out the exit port 48.

Referring still to FIG. 2, a screen 52 may be positioned between the combustion chamber 34 and the orifice plate 28. The screen 52 is porous and may be made of metal or ceramic. The screen 52 catches residue of the gas generant 32 being carried by the exhaust gas exiting the combustion chamber 34. The orifice plate 28 may also include a seal 54. The seal 54 may be made of a thin foil. The seal 54 seals the exhaust gas orifice 44 to retain the fire suppressant 40 within the storage chamber 36 until needed. The seal 54 is readily broken by the exhaust gas.

Preferably, the fire suppressant 40 is a dry powdered fire suppressant such as "Purple-K" (includes $KC_2$, CaC, and silicates). Of course other fire suppressants 40 such as liquids, solids, and foams may also be used. Purple-K is known to be a very effective fire suppressant 40 for fires involving liquids (Class B) and energized electrical equipment (Class C). Generally, powdered fire suppressants born by a gas are very effective in fire hazard zones such as engine compartments. The powdered suppressant readily surrounds and coats the three-dimensional obstructions and components of an engine compartment.

Using a dry powdered fire suppressant 40 allows the storage chamber 36 to be of minimal size. Generally, the combustion chamber 34 is only marginally larger than the space required to store the gas generant 32. Thus, the housing 24 may be very compact in comparison to other gas generant fire extinguishers 16 which may use a liquid or aqueous film-forming foam (AFFF) fire suppressant. Generally, liquid or AFFF fire suppressants require a larger volume of suppressant 40. Thus, a larger storage chamber 36 and larger housing 24 is also required. Large housings 24 limit the number and types of vehicles in which a conventional AFES may be installed aftermarket.

Conventionally, gas generant fire extinguishers 16 using dry powdered fire suppressant 40 require routine maintenance to ensure proper operability for a fifteen to twenty year period. In conventional systems, the dry powdered fire suppressant 40 settles, compacts, and begins to "cake up." Depending on how the extinguisher 16 is designed, the settling may result in little fire suppressant 40 remaining in constant contact with the exhaust gas orifice 44. Thus, minimal fire suppressant 40 is expelled from the extinguisher 16 when activated.

To resolve the problem, conventionally, the extinguisher 16 is removed and new dry powdered fire suppressant 40 replaces the old. Alternatively, the extinguisher 16 may be shaken to loosen and re-arrange the fire suppressant 40 in the chamber 36.

However, in certain embodiments of the present invention, this maintenance is not required. In a preferred embodiment, the extinguisher 16 is installed such that the longitudinal axis 42 is substantially perpendicular to the ground. In this manner, gravity acts on the fire suppressant 40 to maintain substantially constant contact between a majority of the fire suppressant 40 and the exhaust gas orifice 44. Settling and compacting of the fire suppressant 40 is of little significance because the exhaust gas forces through and breaks up the fire suppressant 40 when the extinguisher 16 is activated.

Figure 3:
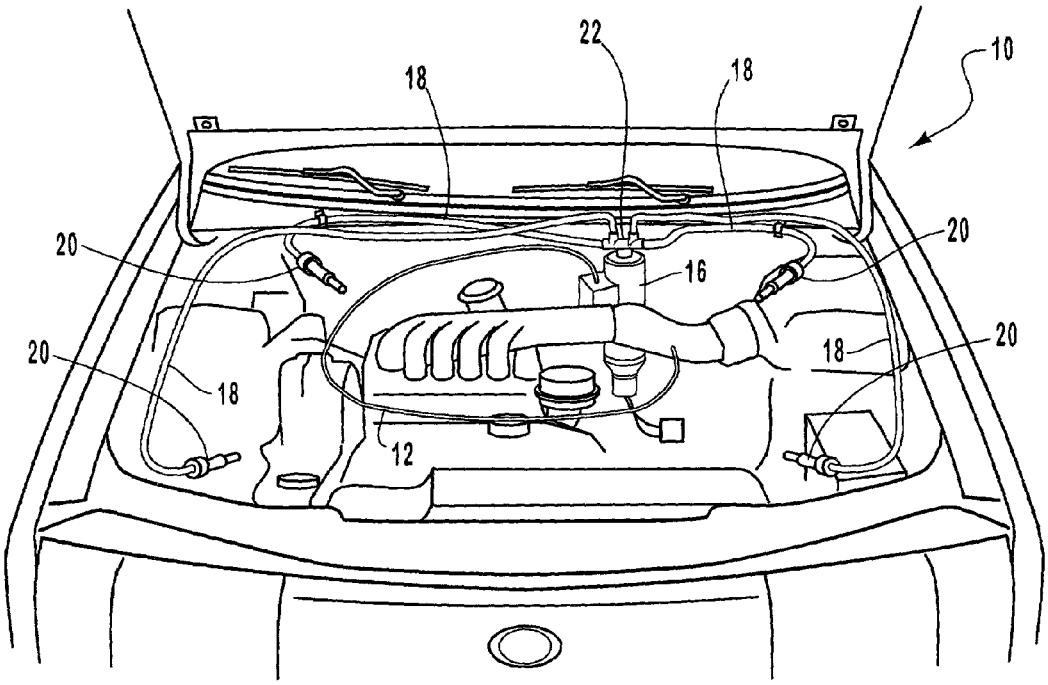
FIG. 3 is a perspective view illustrating one embodiment of a modular fire detection and extinguishing system installed aftermarket in a vehicle.

Referring now to FIG. 3, one embodiment of the AFES 10 is illustrated installed within the engine compartment of a vehicle. A conventional engine compartment may include various components. Generally, the components where a fire is most likely to start such as an exhaust manifold or engine block, are buried beneath other components.

In a preferred embodiment, the AFES 10 includes at least two modular distribution lines 18 positioned near corners of the engine compartment. The fire suppressant 40 carried by the exhaust gas surrounds the components and moves throughout the engine compartment to uniformly and substantially coat all external surfaces. By coating the components, the fuel for the fire, gasoline, oil, plastic, etc. is separated from the oxygen which extinguishes the fire.

Fires may begin in an engine compartment during normal operation of the vehicle or shortly after a vehicle is involved in an accident. In an accident, the hood of a vehicle may be partially opened or completely removed. In addition, the bottom of an engine compartment is generally open. Even though these open areas allow the exhaust gas to escape, the force of the exhaust gas exiting the nozzles 20 and the design and location of the nozzles 20 ensures that the exhaust gas deposits the fire suppressant 40 on the engine components before exiting the engine compartment.

Referring still to FIG. 3, the AFES 10 is preferably compact, modular and capable of independent operation such that the AFES 10 may be readily installed as an aftermarket system. As mentioned above, aftermarket refers to vehicle parts and systems which are not installed when the vehicle is originally manufactured. Alternatively, the AFES 10 may be installed when a vehicle is first manufactured.

In certain embodiments, the AFES 10 may be produced such that the price of an AFES 10 compared to the losses a fire may motivate vehicle owners to purchase the AFES 10. The modular design and low expense of the AFES 10 allows the AFES 10 to be sold in retail outlets including department stores and automotive parts stores.

Because the AFES 10 is compact and self-contained, a do-it-yourself vehicle owner/mechanic may install the AFES 10. A set of simple instructions may be provided to ensure the do-it-yourselfer performs a workable installation. The compact size of the gas generant fire extinguisher 16 allows the extinguisher 16 to be mounted to the firewall of most vehicles using metal screws or other simple fasteners. Preferably, the extinguisher 16 is mounted with the bottom end 30 down and the longitudinal axis 42 substantially perpendicular to the ground.

Figure 4:
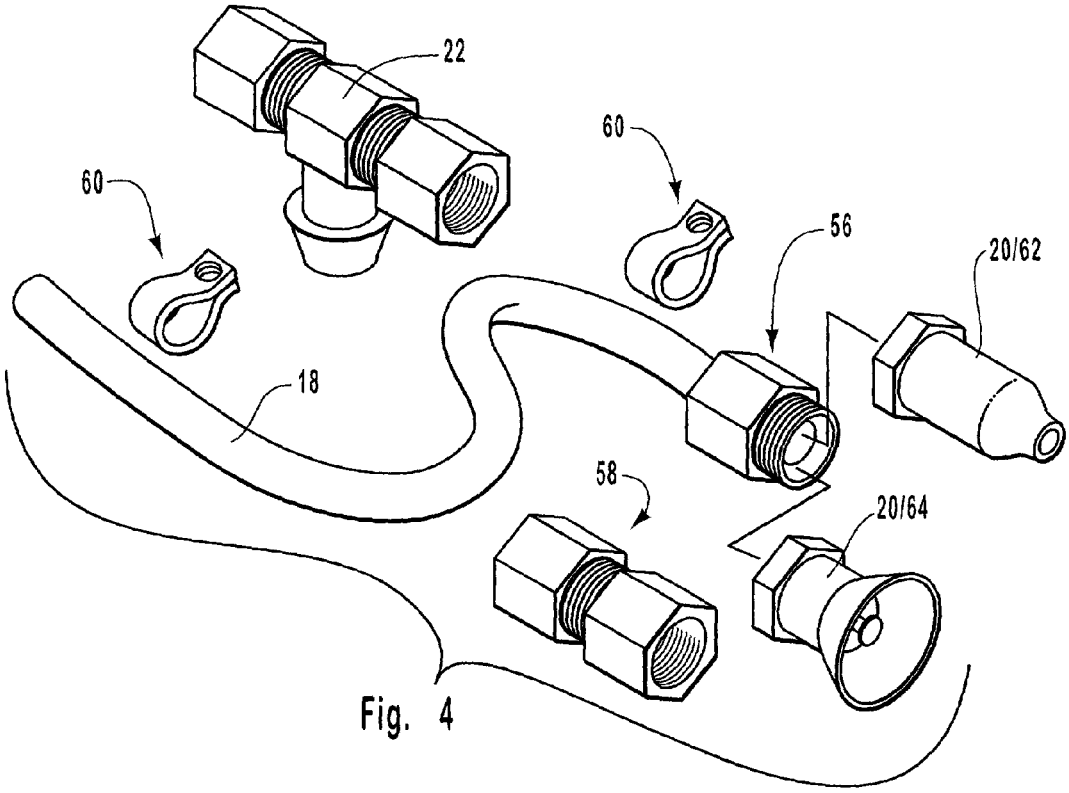
FIG. 4 is a perspective view illustrating one embodiment of components for modular distribution lines.

Referring generally to FIG. 3 and specifically to FIG. 4, the location of the extinguisher 16 is not generally critical to operation of the AFES 10 due to the modularity of the distribution lines 18. Preferably, the lines 18 include a fastener 56 on each end. The fastener 56 allows two or more lines 18 to be removably connected to other components of the AFES 10. For example, a line 18 may be removably connected to a manifold 22 or a nozzle 20.

Two lines 18 may be removably connected to each other using a coupler 58. The coupler 58 joins two lines 18 allowing fluid communication between them. The lines 18 may be provided in different lengths. Thus, by using lines 18 of particular lengths, and/or one or more couplers 58, a nozzle 20 may be positioned at a desired location within the engine compartment regardless of the placement of the extinguisher 16.

Referring still to FIG. 4, the AFES 10 may include one or more strap fasteners 60. The strap fasteners 60 may be used to secure the lines 18 to a wall of the engine compartment. Of course, the fasteners 56 and strap fasteners 60 may be embodied in various forms each within the scope of the present invention.

The AFES 10 may also include nozzles 20 of different configurations which cause the exhaust gas and fire suppressant 40 to disperse in specific patterns. For example, a pointed nozzle 62 may produce a concentrated stream of exhaust gas. The pointed nozzle 62 may be used to reach engine components deep within the engine compartment. Alternatively, a fan nozzle 64 may be installed. The fan nozzle 64 may cause the exhaust gas to disperse. Of course various alternative nozzle shapes may be used. Thus, an untrained do-it-yourselfer may easily assemble and install certain embodiments of the present invention.

Figure 5:
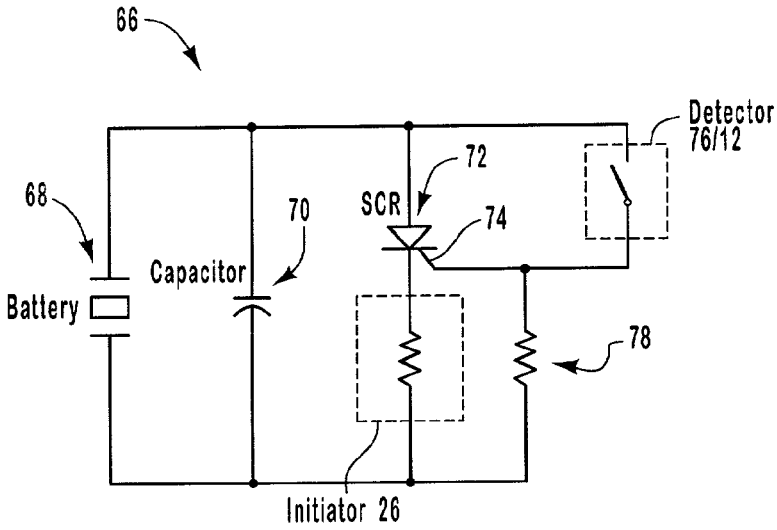
FIG. 5 is a circuit diagram illustrating one embodiment of an electrical circuit for a modular fire detection and extinguishing system which provided redundant power supplies.

Referring now to FIG. 5, an electrical schematic diagram illustrates an electrical circuit 66 according to one embodiment of the present invention. The circuit 66 may include a first power source 68. The first power source 68 provides enough current to activate the initiator 26 in the gas generant fire extinguisher 16. In one exemplary embodiment, the current required to actuate the initiator 26 is about 1.2 amps for about two to three milliseconds.

In one embodiment, the circuit 66 is not connected to another electrical system such as a vehicle's electrical system. The circuit 66 functions independently. Accordingly, the first power source 68 may be a battery with an expected life of about 15 years. Alternatively, the battery 68 may have a shorter life, in which case the battery 68 may be periodically changed.

In the depicted embodiment, the circuit 66 may also include a second power source 70 connected in parallel to the first power source 68. The second power source 70 provides a backup power source. If the first power source 68 fails or is disconnected from the circuit 66 by a fire, the second power source 70 provides the power necessary to activate the initiator 26.

In a preferred embodiment, the second power source 70 is located proximal to a switch 72 within the trigger 14. The first power source 68 may be a battery 68 and the second power source 70 may be a capacitor 70. The capacitor 70 may be a heavy duty capacitor which is designed to survive a vehicle accident. In addition, the electrical connections between the capacitor 70 and the circuit 66 may be reinforced. Therefore, an accident may disable the battery 68, but the capacitor 70 may still hold sufficient current to activate the initiator 26. The capacitor 70 may be as small as 2200 micro farad and store sufficient current for up to about twenty minutes after the first power source 68 is disabled.

Preferably, the switch 72 within the trigger 14 is a silicon controlled rectifier (SCR). Of course other types of switches 72 may also be used. Preferably, the switch 72 is an electrical switch which provides current to the initiator 26. The switch 72 is activated by current which flows into the gate lead 74 of the SCR 72 when a detector 12 closes a detector sub-circuit 76. Generally, the detector sub-circuit 76 is simply a linear temperature sensitive cable detector 12 which closes the detector sub-circuit 76 when a fire causes the cable wires to connect, as discussed above. In one embodiment, the detector 12 may be adapted to close the connection when the temperature along the cable reaches about 365° F. (about 180° C.).

Referring still to FIG. 5, the switch 72 allows an initiation signal, current from a power source 68, 70, to flow to the initiator 26 connected to the gas generant fire extinguisher 16. As illustrated, the initiator 26 generally includes a resistive element which heats up to activate the gas generant 32. As mentioned above, the switch 72 preferably allows about 1.2 amps to flow through the initiator 26 for about two to three milliseconds. A pull down resistor 78 may be included to help prevent false activation of the initiator 26. In one embodiment, the resistance of the pull down resistor 78 may be double the resistance of the initiator 26.

Figure 6:
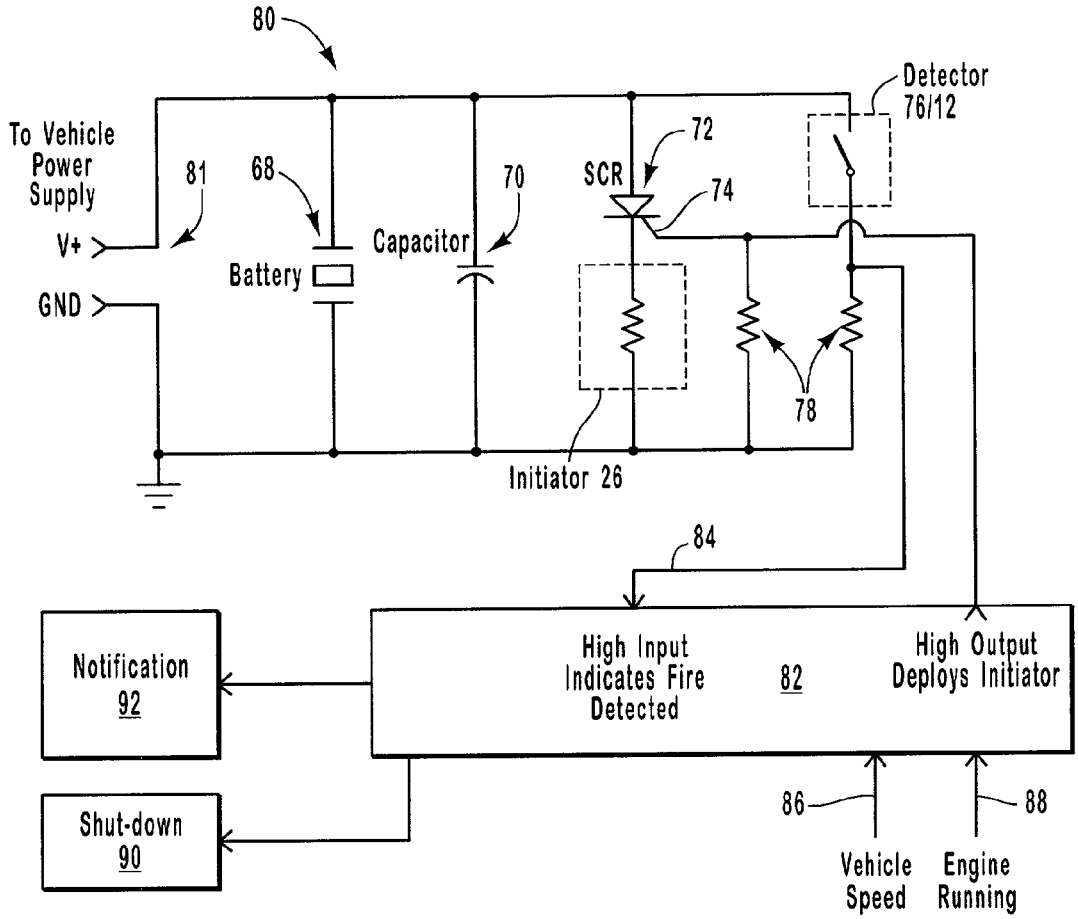
FIG. 6 is a circuit diagram illustrating one embodiment of an electrical circuit for a modular fire detection and extinguishing system which includes a controller to safely combat an engine fire.

Referring now to FIG. 6, an alternative circuit 80 is illustrated. The circuit 80 may include a primary power source 81 which is the power source (alternator or battery) for the vehicle. Thus, three different redundant power sources 68, 70, 81 may be provided to ensure the AFES 10 functions properly.

In this embodiment, the circuit 80 is electrically coupled to a controller 82. The controller 82 activates the switch 72 to allow an initiation signal, current, to flow through the initiator 26 in response to one or more pre-conditions being satisfied. Thus, the mechanical activation of the detector 12 may or may not immediately activate the trigger 14.

A pre-condition may be one or more events which must occur before the controller 82 permits a trigger signal to activate the trigger 14. Pre-conditions allow the AFES 10 to be activated in a more safe and more effective manner than a purely mechanical AFES 10.

For example, because a running engine may continue to feed fuel and heat to a fire, activating the AFES 10 when the engine is running may be futile. However, if the AFES 10 is activated when the engine is shut down, the fire may be more effectively suppressed. But, if the AFES 10 automatically shuts down the engine, vehicle occupants may be placed in more danger than that posed by the fire. For example, the vehicle may be surrounded by other cars on a freeway. Therefore, pre-conditions allow the controller 82 to activate the trigger 14 when it is most safe and efficient to do so. A pre-condition may relate to expiration of a time interval since a fire is detected, to the speed of the vehicle, to whether or not the engine is running, and the like.

In one embodiment, the controller 82 is the vehicle control system such as a main vehicle computer. Alternatively, the controller 82 is a central processing unit (CPU), arithmetic logic unit, state machine, or other form of computer programmed to initiate a trigger signal when input signals indicate certain pre-conditions have been satisfied.

Preferably, the controller 82 receives at least three sources of input information. The first input 84 may send a signal to the controller 82 when a fire is detected by the detector 12. The second input 86 may send a signal indicating the current vehicle speed. The third input 88 may send a signal when the engine is shut down.

Based on these inputs 84, 86, 88, pre-conditions may be programmed in the controller 82. For example, if a fire is detected, a pre-determined time interval has expired, the engine is shut down, and the vehicle is moving at a speed below a pre-determined velocity, then the trigger 14 maybe activated. Otherwise, the trigger 14 is not activated. Of course various combinations of pre-conditions may be programmed in the controller 82.

As illustrated, the controller 82 may communicate with a shut-down module 90. The controller 82 may send a stop signal to the shut-down module 90 which stops the engine. The stop signal may be sent when one or more pre-conditions are satisfied. For example, the pre-condition may be when the velocity of the vehicle is below a pre-determined level.

Furthermore, the controller 82 may be in communication with a notification module 92. The controller 82 may activate the notification module 92 to communicate to vehicle occupants that a fire has been detected. The notification module 92 may include a light, an illuminated message, a sound, a computer synthesized message, or the like.

In certain embodiments, the notification module 92 may be used to send a message to the driver of the vehicle. The message may ask the driver to park the vehicle in a safe location. Once the controller 82 identifies that the vehicle is stopped, the controller 82 may automatically shut down the engine and then activate the trigger 14 to extinguish the fire. Alternatively, the controller 82 may wait until a pre-determined time interval expires once the vehicle stops before activating the trigger 14. The time interval may allow vehicle occupants to exit the vehicle to a safe distance.

In summary, the present invention provides an inexpensive modular aftermarket AFES 10 which may be installed in a variety of vehicles by a novice. The components of the AFES 10 are modular to allow the AFES 10 to readily adapt to different fire hazard zones including engine compartments. The AFES 10 expels a dry powdered fire suppressant 40 to substantially uniformly coat components to extinguish a fire. The AFES 10 further includes double and, in some embodiments, triple redundant power supplies 68, 70, 81 to ensure an AFES 10 will have power to function. In certain embodiments, the AFES 10 includes a controller 82 to activate a gas generant fire extinguisher 16 when it is most effective and safe to do so.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by Letters Patent is:

1. A modular fire detection and extinguishing system, comprising:

a detector for detecting a fire within a fire hazard zone;

a trigger electrically coupled to the detector to generate an initiation signal once the detector detects a fire in the fire hazard zone;

a gas generant fire extinguisher electrically coupled to the trigger to receive the initiation signal, the fire extinguisher comprising a housing that stores gas generant and fire suppressant, the gas generant being stored proximate to a bottom end of the housing, the fire extinguisher further comprising an initiator in communication with the gas generant and an orifice plate within the housing that separates the gas generant from fire suppressant, the orifice plate having an exhaust gas orifice formed therein;

a modular distribution line having one end in fluid communication with the fire extinguisher and the other end connected to a nozzle for dispersing fire suppressant within the fire hazard zone, wherein the modular distribution line comprises a fastener on each end, such that the fasteners allow modular distribution lines to be removably connected to a manifold, the nozzle, and each other by way of a coupler.

2. The system of claim 1, wherein the gas generant fire extinguisher is configured such that gravity maintains substantially constant contact between the fire suppressant and the exhaust gas orifice of the orifice plate.

3. The system of claim 1, wherein the exhaust gas orifice allows exhaust gas generated by actuation of the gas generant to pass through the orifice plate and suspend fire suppressant within the exhaust gas.

4. The system of claim 1, further comprising a manifold in fluid communication with the gas generant fire extinguisher to allow a flow of exhaust gas exiting the extinguisher to enter one or more distribution lines to disperse fire suppressant throughout the fire hazard zone.

5. The system of claim 1, wherein the trigger comprises a first power source, a switch coupled to the power source and the detector, the switch allowing an initiation signal to flow from the power source to the gas generant fire extinguisher when the detector detects a fire.

6. The system of claim 5, further comprising a second power source positioned proximal to the switch.

7. The system of claim 6, wherein the first power source is coupled to the second power source such that the second power source remains operable when the first power source fails.

8. The system of claim 7, wherein the first power source comprises a battery and the second power source comprises a capacitor.

9. The system of claim 1, wherein the detector is a linear temperature sensitive cable.

10. The system of claim 1, wherein the fire suppressant is a dry powdered suppressant.

11. The system of claim 1, wherein the fire suppressant is a liquid suppressant.

12. A modular engine compartment fire detection and extinguishing system for vehicles, comprising:

a detector for detecting a fire within an engine compartment of a vehicle;

a trigger electrically coupled to the detector to generate an initiation signal once the detector detects a fire in the engine compartment;

a gas generant fire extinguisher electrically coupled to the trigger to receive the initiation signal, the fire extinguisher electrically comprising a housing that stores gas and fire suppressant, the gas generant being stored proximate to a bottom end of the housing, the gas generant fire extinguisher further comprising an initiator in communication with the gas generant and an orifice plate within the housing that separates the gas generant from fire suppressant, the orifice plate having an exhaust gas orifice formed therein;

a modular distribution line having one end in fluid communication with the fire extinguisher and the other end connected to a nozzle for dispersing fire suppressant within the engine compartment wherein the modular distribution line comprises a fastener on each end, such that the fasteners allow modular distribution lines to be removably connected to a manifold, nozzle, and each other by way of a coupler.

13. The system of claim 12, wherein the gas generant fire extinguisher is configured such that gravity acts to maintain substantially constant contact between the fire suppressant and the exhaust gas orifice of the orifice plate.

14. The system of claim 13, wherein the exhaust gas orifice allows exhaust gas generated by actuation of the gas generant to pass through the orifice plate and suspend fire suppressant within the exhaust gas.

15. The system of claim 12, further comprising a manifold in fluid communication with the gas generant fire extinguisher to allow a flow of exhaust gas exiting the extinguisher to enter one or more distribution lines to disperse fire suppressant throughout the engine compartment.

16. The system of claim 12, wherein the trigger comprises a first power source, a switch coupled to the power source and the detector, the switch allowing an initiation signal to flow from the power source to the gas generant fire extinguisher when the detector detects a fire.

17. The system of claim 16, further comprising a second power source positioned proximal to the switch.

18. The system of claim 17, wherein the first power source is coupled to the second power source such that the second power source remains operable when the first power source fails.

19. The system of claim 18, wherein the first power source comprises a battery and the second power source comprises a capacitor.

20. The system of claim 12, wherein the detector is a linear temperature sensitive cable.

21. The system of claim 20, wherein the fire suppressant is a dry powdered suppressant.

22. The system of claim 20, wherein the fire suppressant is a liquid suppressant.

23. The system of claim 21, wherein exhaust gas coats an engine within the engine compartment with the fire suppressant.

24. The system of claim 23, wherein the system operates independently of other vehicle systems.

* * * * *